US011712813B2

(12) United States Patent
Gallegos

(10) Patent No.: US 11,712,813 B2
(45) Date of Patent: Aug. 1, 2023

(54) ADJUSTABLE BLADE DEPTH PEN CUTTER

(71) Applicant: Slice, Inc., Sunny Isles, FL (US)

(72) Inventor: Robert Joseph Gallegos, Fremont, CA (US)

(73) Assignee: Slice, Inc., Sunny Isles, FL (US)

( * ) Notice: Subject to any disclaimer, the term of this patent is extended or adjusted under 35 U.S.C. 154(b) by 14 days.

(21) Appl. No.: 17/562,707

(22) Filed: Dec. 27, 2021

(65) Prior Publication Data

US 2022/0347870 A1 Nov. 3, 2022

Related U.S. Application Data

(63) Continuation-in-part of application No. 17/243,808, filed on Apr. 29, 2021.

(51) Int. Cl.
*B26B 5/00* (2006.01)
*B26B 1/08* (2006.01)

(52) U.S. Cl.
CPC ..... *B26B 5/003* (2013.01); *B26B 1/08* (2013.01); *B26B 5/001* (2013.01)

(58) Field of Classification Search
CPC .. B26B 1/00; B26B 1/08; B26B 5/001; B26B 5/003
USPC ..... 30/161–162
See application file for complete search history.

(56) References Cited

U.S. PATENT DOCUMENTS 10,569,433 B1 * 2/2020 Wong ..... B26B 1/08
2020/0070371 A1 * 3/2020 Wong ..... B26B 5/003

FOREIGN PATENT DOCUMENTS

JP 2017064300 A * 4/2017 ..... B26B 1/08

* cited by examiner

*Primary Examiner* — Nhat Chieu Q Do
(74) *Attorney, Agent, or Firm* — McCarter & English, LLP; James M. Smedley; Alex Korona

(57) ABSTRACT

A cutting device has a selectively replaceable and reorientable blade. The cutting device includes a housing and a carriage that is movably disposed in the housing, the carriage being movable between a retracted position and an extended position. The cutting device also has a cutting member that is removably disposable and reorientable in the carriage and a cover member that is removably attachable to the housing. Further, the cutting device includes an adjustable blade depth assembly providing the ability to direct and/or pre-select the depth or length a blade disposed in the carriage will reach upon engagement of a dial component and/or switch member operably connected to the blade carriage.

18 Claims, 4 Drawing Sheets

ADJUSTABLE BLADE DEPTH PEN CUTTER

CROSS-REFERENCE TO RELATED APPLICATIONS

This application is a continuation-in-part of U.S. application Ser. No. 17/243,808, entitled "Slim Pen Cutter", filed on Apr. 29, 2021, the entire disclosure of which is incorporated herein by reference.

TECHNICAL FIELD

The present disclosure generally relates to a cutting device, and more particularly to a manual or automatic retracting cutting device having a blade carriage in mechanical communication with an adjustable blade depth assembly providing the ability to pre-select the depth or length a blade disposed in the blade carriage will reach, for example, upon engagement of a switch member and/or a dial component operably connected to the blade carriage.

BACKGROUND

Adjustable pen cutters presently exist in the art, however, prior developed pen cutters lack at least: a blade carriage configuration provided for easily replacing or reorienting a blade, a blade depth indicator, for easily and clearly determining how far a blade disposed in the blade carriage may travel upon engagement of the cutting device switch member, and a blade cover having a blade outlet slot and formed as a removable cap, adapted to be removed to easily and conveniently remove, replace and/or reorient a blade. These and other features and advantages of the present invention will be explained and will become obvious to one skilled in the art through the summary of the invention that follows.

SUMMARY OF THE DISCLOSURE

In one exemplary aspect, the present disclosure is directed to a cutting device. The cutting device may include a housing and a carriage that is movably disposed in the housing, the carriage being movable between a retracted position and an extended position. The cutting device may also include a cutting member that is removably disposable in the carriage and a blade cover member that is removably attachable to the housing.

It is an object of the present invention to provide a cutting device which incorporates a means for adjusting (e.g. preselecting) the blade length to be exposed outside the housing of the cutting device. In some scenarios, the cutting device may incorporate a means for adjusting the blade length to be exposed outside the blade outlet slot of the cover member of the cutting device.

It is another object of the present invention to provide a cutting device with a blade position adjustment assembly for easily selecting and maintaining a precise cutting depth for any given use or project.

It is another object of the present invention to provide an adjustment dial component to control the extension of the blade out of the housing (e.g. to control how far the blade may extend upon the forward engagement of the switch member).

It is another object of the present invention to provide a blade position adjustment assembly which supports the setting of the cutting depth of the blade (e.g. in a user selected or predetermined position), such that upon engagement or use of a slider switch, the blade may become exposed to the extent pre-selected by the user.

It is another object of the present invention to provide a tension component, such that when the slider switch is released (e.g. disengaged), the blade may automatically spring back into the housing. In some scenarios, this configuration may protect users while the tool is not in use.

It is another object of the present invention to provide a cutting device having a blade cover member at a left-side portion of the housing which may be removed to gain access to the blade and blade carriage.

It is another object of the present invention to provide cutting device having a blade carriage which is able to receive and retain a blade in at least two different orientations, for example, such that the cutting device is compatible for both left-handed and right-handed users (e.g. ambidextrous).

It is another object of the present invention to provide a cutting device having a blade carriage with one or more locking members configured to substantially secure a blade within the blade carriage, to prevent the blade from displacement, for example, when the cover member is removed for blade changes, for example, blade replacement or reorientation, and also configured to easily release a blade when so desired by a user.

It is another object of the present invention to provide a cutting device having a blade position indicator.

It is another object of the present invention to provide a manually extendable and retractable blade assembly configured to extend from or retract into the cutting device house upon engagement of an adjustment dial component.

BRIEF DESCRIPTION OF THE DRAWINGS

Accompanying this written specification is a collection of drawings of exemplary embodiments of the present invention. One of ordinary skill in the art would appreciate that these are merely exemplary embodiments, and additional and alternative embodiments may exist and still be within the spirit of the invention as described herein.

DETAILED DESCRIPTION

Figure 1:
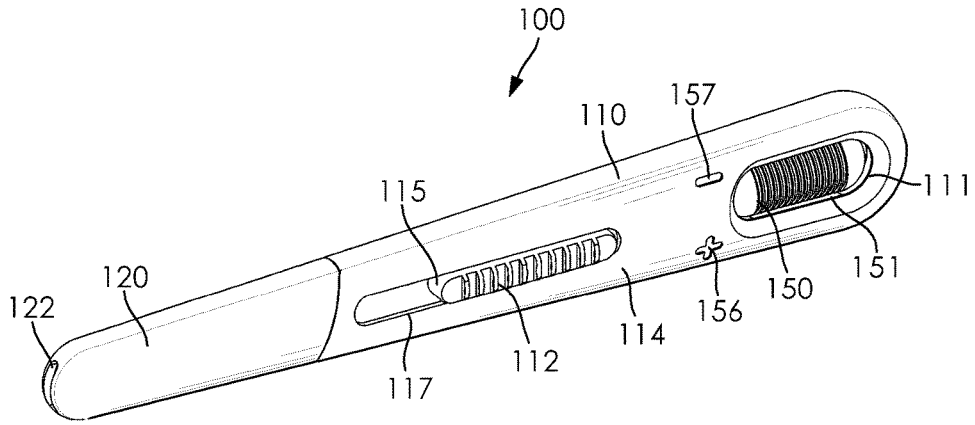
FIG. 1 is a perspective view of an exemplary automatically retractable cutting device with a retracted blade in accordance with an embodiment of the present invention.

The present invention generally relates to a cutting device. Specifically, embodiments of the present invention relate to a pen cutter apparatus with an adjustably extendable blade. Embodiments of the pen cutter apparatus may further comprise a housing with a blade carriage movably disposed therein.

In accordance with embodiments of the present invention, a pen cutter apparatus may comprise a main body housing, a blade, a blade carriage, a blade position adjustment assembly, and a blade cover member having a blade outlet slot. Certain embodiments of the present invention may include fewer components or additional components depending on the utilization and purpose for the pen cutter.

In accordance with embodiments of the present invention, the housing of the pen cutter apparatus may be configured to receive and retain at least a portion of a blade, a blade carriage, and a blade position adjustment assembly. In some embodiments, the main body housing may be comprised of two corresponding halves, a front body shell and a rear body shell, that may be configured to contain the other components of the pen cutter. In some embodiments, the main body housing may be substantially slim and elongate and configured to permit deft movement while cutting. In some embodiments, the housing may comprise housing engagement members configured to align and connect the front body shell with the rear body shell. One of ordinary skill in the art would appreciate that the housing could be designed in any number of configurations, and embodiments of the present invention are contemplated for use with any such configuration.

In accordance with embodiments of the present invention, the main body housing may provide, for example, a handle for use by a user. For example, the main body housing may be configured as a handle of a pen cutter, a seam ripper, a box cutter, utility knife, or precision knife. In some examples, the main body housing may be a substantially hollow housing configured to receive and retain a blade carriage as well as additional components such as the exemplary components described herein. In some scenarios, the main body housing may be an elongate housing that tapers from a first side to a second side of the housing. In some examples, the main body housing may be any suitable shape such as, for example, a substantially regular tube shape, e.g., a square, triangular, hexagonal, and/or octagonal shape.

In accordance with embodiments of the present invention, the main body housing of the pen cutter may comprise front and rear body shells. Either or both of the body shells may comprise some or all of the following: a blade carriage outlet slot, a blade carriage track outlet slot, a switch member slot, a position indicator slot, an adjustment dial opening, one or more housing connector members, one or more blade cover connector components, and one or more carriage track connector components. The front and rear body shells may connect via housing engagement means, for example, hollow channels disposed on the front and rear body shells and adapted to engage with elongate connecting members, which may, for example, friction fit within the hollow channels in the body shells. In some examples, the housing engagement means may include screws, pins, adhesives or any other similarly suitable engagement means for connecting the front and rear body shells. The blade carriage outlet slot may be an indentation formed at a side portion of the front and rear body shells that may be configured to receive at least a portion of the blade and may create a passage to an internal portion of the pen cutter. In some embodiments, the blade carriage track may define a path for the movement of the blade carriage within the main body housing. The adjustment dial opening may be adapted to receive an adjustment dial and permit its rotation. One of ordinary skill in the art would appreciate that are numerous suitable configurations for the housing of the pen cutter, and embodiments of the present invention are contemplated for use with any such configuration.

In accordance with embodiments of the present invention, the cutting device may include a cutting assembly. The cutting assembly may comprise a blade carriage, a blade channel, a blade, and a switch member and may be configured to move forward and backward within the main body housing. The cutting assembly may be configured to extend and retract to move the blade, for example, to extend or retract the blade out of or into the main body housing, as desired by a user. The blade carriage may be engaged with a switch member which may be configured to control the retraction and extension of the blade carriage and the blade disposed in the blade channel. The blade carriage and switch member may be integrally formed units (e.g one piece comprising both components), for example, the blade carriage may extend from the switch member, or may be two separate components configured to interact with or otherwise operably connect to one another. In some examples, the cutting assembly may be configured to manually extend and automatically retract. For example, the blade carriage may be operably connected to a tension component, for example, a spring, configured to bias the blade carriage towards the retracted blade carriage position such that after a forward (or lateral) force is exerted on the blade carriage to extend the blade in the blade carriage out of the blade outlet slot is released, the blade carriage automatically returns to a retracted position as a result of the biasing force of the tension component. In some examples, the cutting assembly may be configured to manually extend and retract. For example, the blade carriage may be operably connected to the adjustment dial component, and the adjustment dial component may be adapted to rotate clockwise or counterclockwise and engage with the blade carriage in a manner that moves the blade assembly forward and backward within the housing to manually move the blade from an extended blade position to a retracted blade position and vice versa.

One of ordinary skill in the art would appreciate that there are many suitable designs for a cutting assembly, and embodiments of the present invention are contemplated for use with any such design.

In accordance with embodiments of the present invention, the cutting assembly may comprise a blade carriage. The blade carriage may be configured with a spine or top side and a "belly" or bottom side and may be configured to releasably or removably retain a blade. The blade carriage may also be configured with a front side and a rear side. The front side of the blade carriage may have a blade channel and a switch member disposed thereon. The rear side of the blade carriage may have a position setting component track and an indicator component track formed therein including a track portion and a stopper or blocker portion. In some examples, the position setting component track may be configured to support the movement of the position setting component and/or the indicator component and to stabilize the movement of the position setting component and/or the position indicator component along the post of the adjustment dial component. The stopper or blocker portion of the blade carriage may be formed opposite the switch member of the cutting assembly and may be configured to prevent movement of the blade carriage (and the blade that may be disposed thereon) past the position setting component towards the left-side of the housing and/or the cover member (e.g. the position setting component may prevent the blocker portion of the blade carriage from progressing within the housing). One of ordinary skill in the art would appreciate that there are many suitable designs for a blade carriage, and embodiments of the present invention are contemplated for use with any such design.

In accordance with embodiments of the present invention, the blade carriage may comprise a blade channel. The blade channel may be configured to releasably retain the blade in one of many available positions. For example, the blade channel may retain the front or rear tip of the blade nearest the blade outlet slot when the blade carriage is in the retracted position. Also for example, the blade channel may retain the blade with the spine of the blade corresponding or aligned with the spine of the blade carriage, or may be flipped, such that the spine of the blade corresponds or aligns with the belly or bottom side of the blade carriage. The blade channel may be configured with one or more locking members, for example, protruding members which may each include one or more indented portions and one or more tab implements. The locking members, for example, the tab implements of the blade channel, may be configured to correspond with a notch in the blade to assist in retaining the blade within the blade channel. The indented portions in the locking members may be configured to receive any one of the edges of the blade. In some examples, at least one indented portion may be configured to receive a cutting edge (or "belly") side of the blade and at least one indented portion may be configured to receive a rear edge of a blade (e.g. the rear edge disposed between the spine and "belly" sides of a blade). The indented portions may be, for example, gaps, slits, slots or other indents suitable (e.g. dimensioned and/or shaped) to receive an edge portion of a blade, for example, a cutting edge or a rear edge portion of a blade. The locking members may be configured to substantially secure the blade to the blade channel, for example, to substantially secure the rear edge portion of the blade to the blade channel, to prevent the blade from displacement, for example, when the cover member is removed for blade changes, for example, blade replacement or reorientation, and may also be configured to easily release a blade when so desired by a user (e.g. after removal of the blade cover from the housing). One of ordinary skill in the art would appreciate that there are many suitable designs for a blade channel, and embodiments of the present invention are contemplated for use with any such design.

In accordance with embodiments of the present invention, the cutting assembly may comprise a blade carriage track. The blade carriage track may be an independent member and may be disposed between the rear or front body shells and the blade carriage. Alternatively or additionally, the blade carriage track may be formed on either or both of the front and rear body shells. In some examples, the blade carriage track may include a blade carriage channel. The blade carriage channel may be a void formed in the blade carriage track that creates a passage for blade carriage to move from a first position to a second position. The blade carriage channel may be configured as a sheath and may stabilize the movement of the blade carriage. One of ordinary skill in art would appreciate that there are numerous types and configurations for a blade carriage track, and embodiments of the present invention are contemplated for use with any such blade carriage track.

In accordance with embodiments of the present invention, the cutting device may comprise a blade position adjustment assembly. The blade position adjustment assembly may comprise some or all of the following components: an adjustment dial component, a position setting component, and a position indicator component. The adjustment dial component may comprise a dial component, for example, a roller, and a post component. In some examples, the dial component may be substantially ovoid-shaped and the post component may be threaded. In some embodiments, the dial component may be rotatably retained in the adjustment dial opening of the housing. In some examples, the rotation of the dial component may direct the threaded post to rotate. In some examples, the dial component may be any other similarly suitable shape which would permit its rotation within the adjustment dial opening of the housing and direct the rotation of the post component, for example, spherical, cylindrical, or conical shapes or triangular, rectangular, hexagonal, or pentagonal prisms. The post component of the adjustment dial may be operably engaged with the position setting component, which may comprise one or more rotatable members, for example, one or more rotatable nuts having an internal threaded portion. A rotatable member may be configured to travel laterally along the post component, upon clockwise or counter-clockwise rotation of the dial component. In some examples, a rotatable member may be disposed between (e.g. sandwiched between) a pair of flanges of the position indicator component, with an elongate member of the position indicator component configured to travel along-side or otherwise in coordination with the post component, upon rotation of the adjustment dial component and the resulting lateral movement of the rotatable member disposed thereon. The position of the position setting component may adjustably set the movement boundary of the blade carriage, for example, by setting the movement boundary of the blade carriage and/or the slider switch which are adapted to travel alongside the post component. For example, a rotatable member may be configured to move laterally along the adjustment dial post upon rotation of the dial component and the threaded post extending therefrom, and may be configured to move to a position selected by a user to block the progressive movement of the slider switch and/or the blade carriage past the position selected by a user. In some examples, once the user-selected position of the position setting component is set, a rotatable member or a flange of the position indicator component may prevent the lateral movement of the slider switch past a certain extent (e.g. the position setting component may set the maximum movement boundary of the slider switch, for example, a maximum forward movement boundary of the slide switch, thereby potentially setting the maximum movement boundary (e.g. maximum pre-selected depth) of the blade operably connected thereto).

In some examples, a portion of the blade position adjustment assembly, for example, the position setting component of the blade position adjustment assembly, may include a position indicator component configured to indicate a selected extension position (e.g. the level or amount of extension a blade would achieve upon the forward engagement of the slider switch). In some examples, the position indicator component may comprise an elongate member having one or more flanges formed with at least one opening on one side thereof, and an indicator such as a protrusion, stud, button or other similar visual indicator formed on an opposite side thereof which may be moved in coordination with the position setting component and its position may be viewed within the housing position indicator slot. In some examples, the position indicator may be colored, for example, brightly colored, to support easy recognition or registration of its position by a user. In some examples, near the position indicator slot may be disposed predetermined, for example, engraved, indicator positions, for example, hash mark indicator positions, to make setting the blade position (e.g. depth) more visible and apparent to a user. For example, an exterior surface of the rear body shell may include hash mark indicator positions to indicate the relative position of the position indicator component, which may be configured to correspond to the extent to which the blade will extend upon a user's forward engagement of the switch member. In some scenarios, the position setting component (e.g. the rotatable member) of the blade adjustment assembly may be disposed between a pair of flanges extending from the elongate member of the position indicator component. Each of the flanges of the pair of flanges may have an opening configured to receive a portion of the post component. As such, the position indicator component may move along the post component in coordination with the movement of the position setting component. One of ordinary skill in the art would appreciate that there are many suitable designs for a blade position adjustment assembly, and embodiments of the present invention are contemplated for use with any such design.

In accordance with embodiments of the present invention, the cutting device may comprise a switch member. The switch member may engage or connect with the blade carriage, the blade carriage configured to engage with the blade carriage track in a manner that allows the blade carriage to be aligned to slide forward and backward within the main body housing. In some examples, the position setting component of the position adjustment assembly may be configured to adjustably set the movement boundary of the slider switch, thereby setting the movement boundary of the blade carriage and blade operably connected thereto. One of ordinary skill in the art would appreciate that there are many suitable designs for a switch member, and embodiments of the present invention are contemplated for use with any such design.

In accordance with embodiments of the present invention, the cutting assembly may comprise a tension component. The tension component, for example, a spring, may be disposed between the blade carriage and an internal wall of the main body housing. In some examples, the blade carriage and an internal wall of the main body housing may each include a tension component holder adapted to retain an end of the tension component. The tension component may be configured to bias the blade carriage towards the retracted position such that a blade disposed in the blade channel may be biased towards the interior of the main body housing. In some scenarios, if a force, for example, a forward force, greater than the biasing force applied by the tension component is applied to the switch member connected to the blade carriage, the blade carriage may move forward such that the blade disposed in the blade channel may extend past the blade outlet slot in the blade cover member. Moreover, if a force is not applied the switch member or the blade carriage (or the force applied to the blade carriage is lower than the biasing force applied by the tension component), the tension component may direct the blade carriage to automatically retract to return the blade to its retracted position. One of ordinary skill in the art would appreciate that there are many suitable designs for a tension component, and embodiments of the present invention are contemplated for use with any such design.

In accordance with embodiments of the present invention, a blade may be disposed within the pen cutter. The blade may be permanent or exchangeable, and may be secured in the blade holder by any suitable means, including one or more of numerous fasters such as rivets, bolts and screws, friction fit, adhesives, and combinations thereof. For example, the blade channel of the blade carriage may be configured to provide a friction fit by its tight-fitting structure. Moreover, the blade may be configured with a notch to be permanently or releasably secured by a corresponding structure, for example, a locking member, in the blade channel. The blade may be configured with a spine and a cutting edge on opposite sides of its width, and a front tip and a rear tip on opposite sides of its length. In some scenarios, the blade may be releasably secured to the blade channel in one of many available positions, for example, the blade may be disposed in the blade channel with the front or rear tip of the blade nearest the blade outlet slot. Also for example, the blade may be disposed in the blade channel with the spine of the blade corresponding to the spine of the blade channel, or may be flipped, such that the spine of the blade corresponds to the belly side of the blade channel. In any embodiment, the blade may be made from any suitable material, including, but not limited to, metal, ceramic, or any combination thereof. One of ordinary skill in the art would appreciate that there are numerous configurations and materials that might be used for the blade, and embodiments of the present invention are contemplated for use with any such material or configuration.

In accordance with embodiments of the present invention, the blade that is used may be constructed from a ceramic material that is capable of withstanding extended use without becoming dull or unusable. Ceramic materials appropriate for such construction include, but are not limited to, Zirconium Oxide. One of ordinary skill in the art would appreciate that there are numerous ceramic materials that could be utilized with embodiments of the present invention.

In accordance with embodiments of the present invention, the cutting device housing may include an opening configured to receive or connect with a keychain, hook, carabiner, clasp, lanyard, or other similarly suitable connector members. One of ordinary skill in the art would appreciate that there are many suitable designs for an opening and embodiments of the present invention are contemplated for use with any such design.

According to an embodiment of the present invention, the blades used in the pocket cutter may contain rounded tips to reduce the chance of injury.

Figure 10:
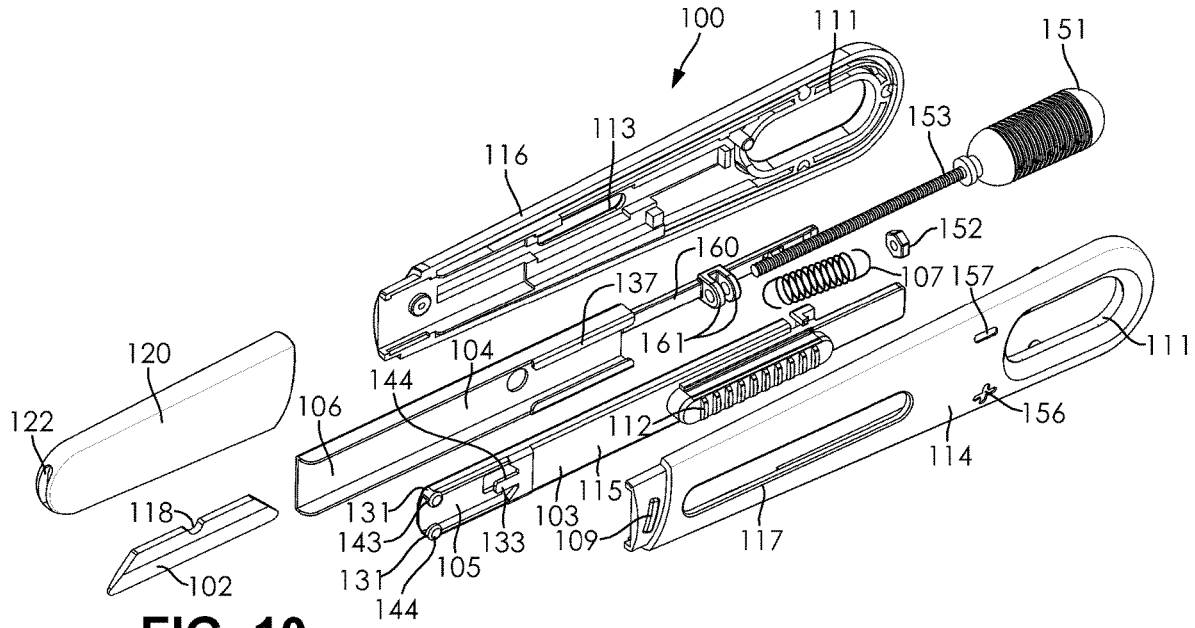
FIG. 10 is a front perspective exploded view of an exemplary automatically retractable cutting device in accordance with an embodiment of the present invention.
Figure 11:
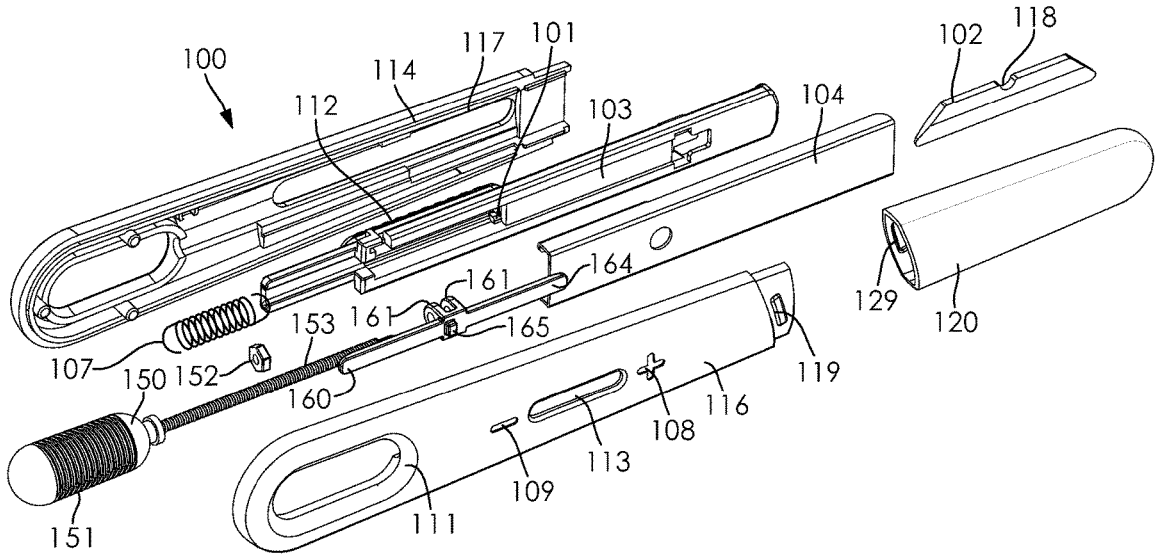
FIG. 11 is a rear perspective exploded view of an exemplary automatically retractable cutting device in accordance with an embodiment of the present invention.
Figure 12:
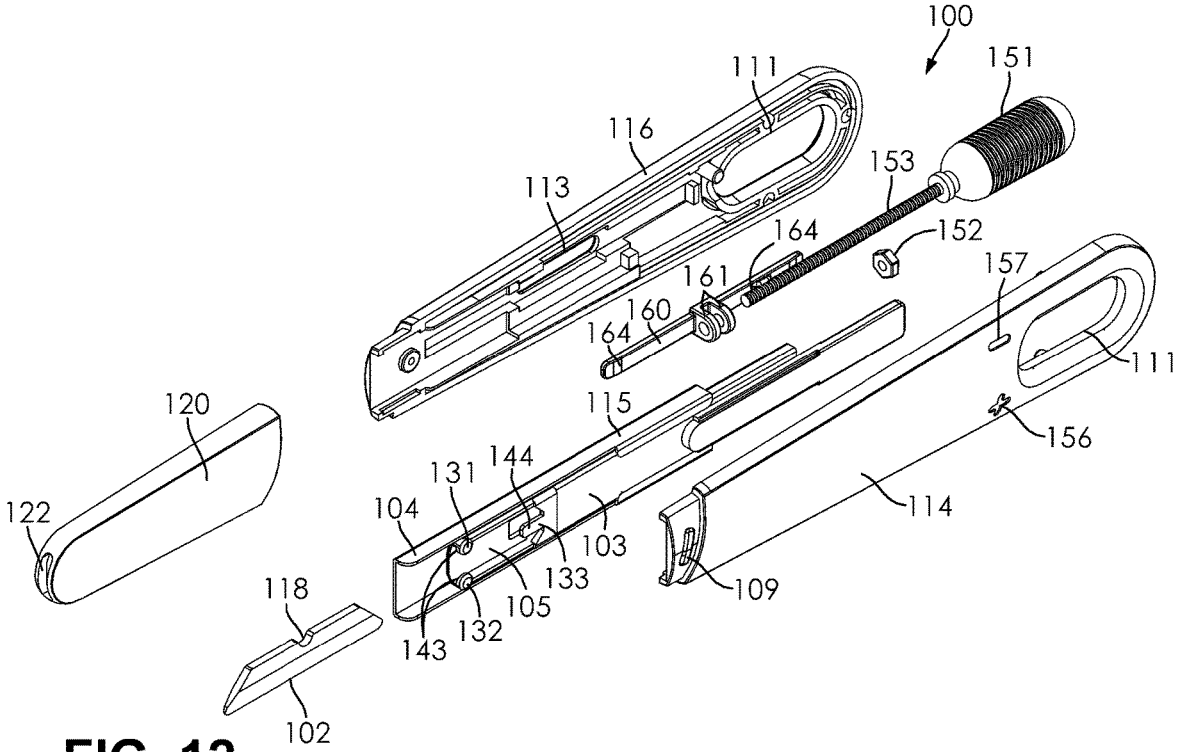
FIG. 12 is a front perspective exploded view of an exemplary manually retractable cutting device in accordance with an embodiment of the present invention.
Figure 13:
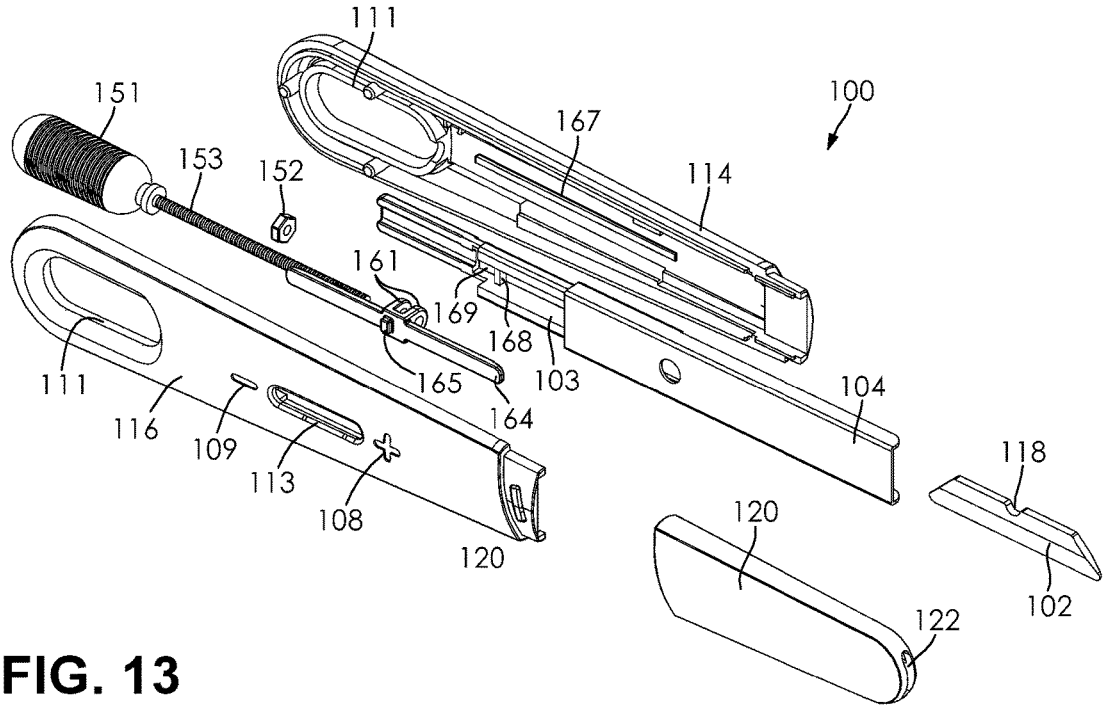
FIG. 13 is a rear perspective exploded view of an exemplary manually retractable cutting device in accordance with an embodiment of the present invention.

FIGS. 1-11 generally depict an automatically retractable adjustable depth pen cutter 100 comprising a housing 110, a blade 102, a blade carriage 103, and a blade adjustment assembly 150. FIGS. 12-13 generally depict a manually extendable and retractable adjustable depth pen cutter 100 comprising a housing 110, a blade 102, a blade carriage 103 and a blade adjustment assembly 150. As demonstrated by the figures, automatically retractable and manually retractable adjustable depth pen cutters may comprise substantially similar componentry, including a main body housing 110, a front body shell 114, a rear body shell 116, a blade 102, a cover 120 having a blade outlet slot 122, a dial component 151, a post component 153, a position setting component 152, and a position indicator component 160.

Figure 3:
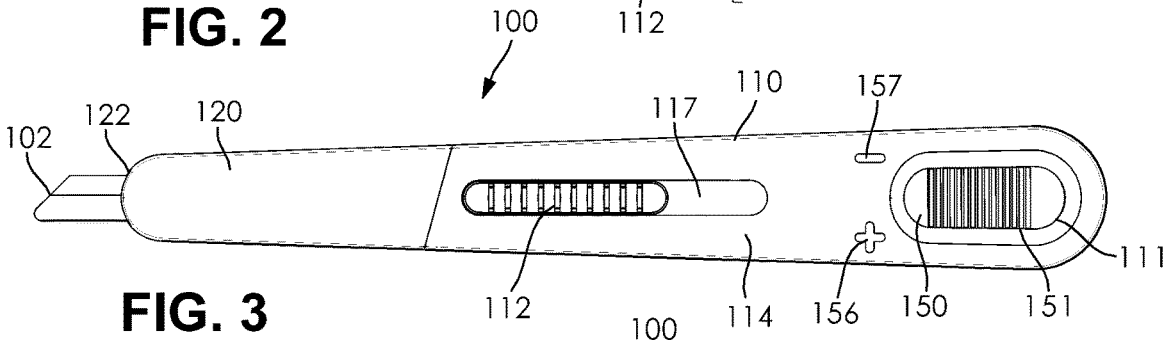
FIG. 3 is a front view of an exemplary cutting device with an extended blade in accordance with an embodiment of the present invention.

Turning now to the figures, FIG. 1 depicts a perspective view of an exemplary automatically retractable cutting device with a retracted blade in accordance with an embodiment of the present invention. As shown in FIG. 1, the cutting device 100 may include a main body housing 110, a blade 102 (as shown in FIG. 3), a switch member 112, a cover member 120 having a blade outlet slot 122, and a blade adjustment assembly 150. The cover member 120 may be removably attachable to housing 110, for example, at a portion of the housing 110 where the front body shell 114 and the rear body shell 116 (as shown in FIGS. 10 and 11) connect. In some examples, the cover member 120 may be configured to friction fit, snap fit, or pressure fit with the housing 110 to releasably connect to the housing 110. In any embodiment, the cover member 120 may connect to the housing in any similarly suitable manner which permits the cover member 120 to be easily attached and detached from the housing 110, for example, from the left-side of the housing 110, as desired by a user. The housing 110 may include an aperture 117 formed on a portion of the front body shell 114 of housing 110, for example, a wall portion of front body shell 114, such as an exterior wall portion. The aperture 117 may receive a portion of cutting assembly 115. For example, the aperture 117 may be an elongated aperture that movably receives a portion of cutting assembly 115. For example, aperture 117 may be an elongated aperture (e.g., an elongated groove) along which a portion of cutting assembly 115, for example, a switch member 112 may be moved. In some examples, indicator components 156 and 157 may be disposed on the front body shell 114 of the housing 110.

Figure 2:
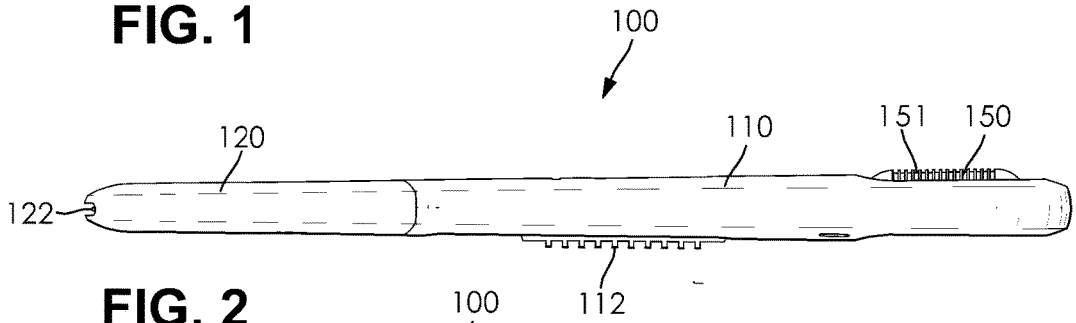
FIG. 2 is a top view of an exemplary automatically retractable cutting device with a retracted blade in accordance with an embodiment of the present invention.

FIG. 2 depicts a top view of an exemplary automatically retractable cutting device with a retracted blade in accordance with an embodiment of the present invention. As shown in FIG. 2, the cutting device 100 may comprise a housing 110, a slider switch 112, a cover 120 comprising a blade outlet slot 122 and removably attachable to the housing 110, and a blade adjustment assembly 150 comprising an adjustment dial component 151.

Figure 4:
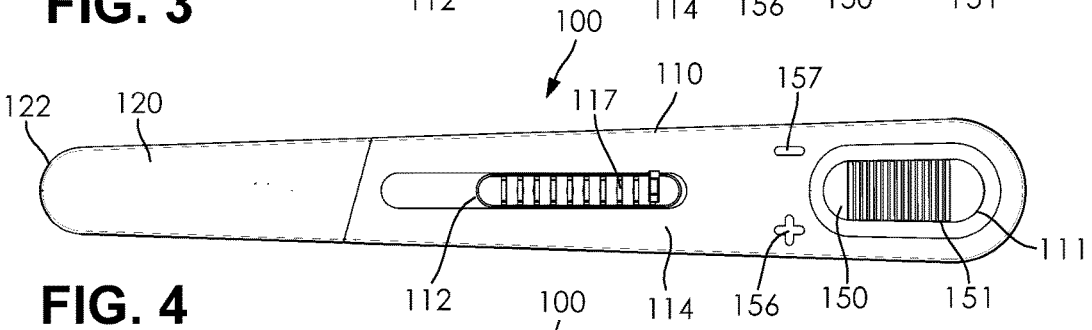
FIG. 4 is a front view of an exemplary automatically retractable cutting device with a retracted blade in accordance with an embodiment of the present invention.

FIG. 3 depicts a front view of an exemplary automatically retractable cutting device with an extended blade in accordance with an embodiment of the present invention. FIG. 4 depicts a front view of an exemplary cutting device with a retracted blade in accordance with an embodiment of the present invention. As shown in FIGS. 3 and 4, the cutting device 100 may comprise a housing 110, a blade 102, a switch member 112, a cover member 120 connectable to the housing 110, and a blade adjustment assembly 150. In the depicted example, a dial adjustment component 151 of the blade adjustment assembly 150 is accessible and rotatable through the dial outlet slot 111 in the housing 110. In FIG. 3, the slider switch 112 is in a forward position in the slider switch slot 117, and the blade 102 is substantially extended. In FIG. 4, the slider switch 112 is in a rear position in the slider switch slot 117, and the blade 102 is retracted in the housing 110. In the depicted example, near the dial outlet slot 111, for example, on an exterior surface of the front body shell 114, may be a "+" indicator component 156 and a "−" indicator component 157 which may assist users in determining which direction the dial component 152 (as shown in FIGS. 10 and 11) should be rotated to move the position setting component 152 of the blade adjustment assembly 150 to achieve a particular blade length or depth desired by the user upon engagement of the switch member 112.

Figure 5:
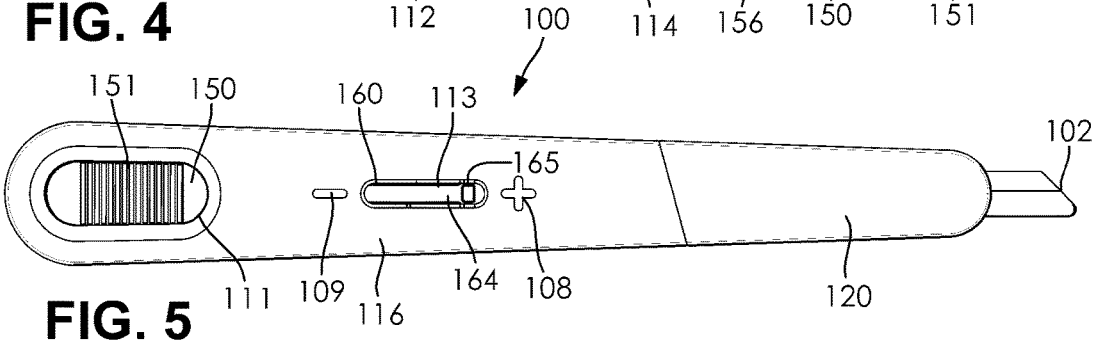
FIG. 5 is a rear view of an exemplary automatically retractable cutting device with an extended blade in accordance with an embodiment of the present invention.
Figure 6:
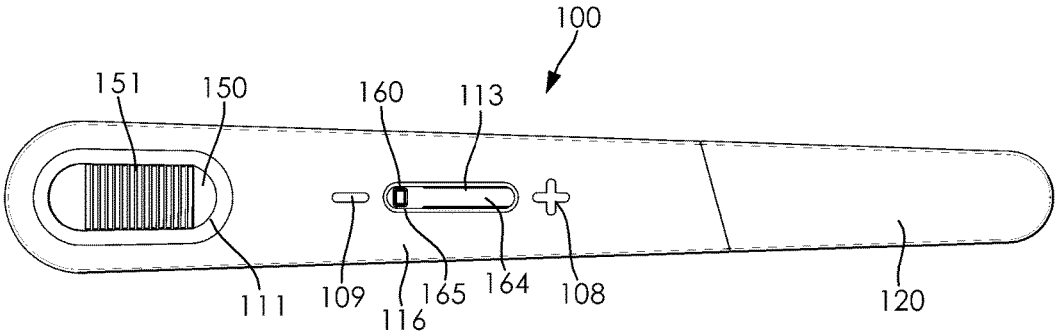
FIG. 6 is a rear view of an exemplary automatically retractable cutting device with a retracted blade in accordance with an embodiment of the present invention.

FIG. 5 is a rear view of an exemplary automatically retractable cutting device with an extended blade in accordance with an embodiment of the present invention. FIG. 6 is a rear view of an exemplary cutting device with a retracted blade in accordance with an embodiment of the present invention. As shown in FIGS. 5 and 6, the rear body shell 116 may include a position indicator slot 113 configured as an opening and providing a view of at least a portion of the position indicator component 160, for example, a view of the protruding indicator 165 of the position indicator component. In some embodiments, the protruding indicator 165 may have a distinctive color, for example, a bright red color, to make the position of the position indicator component 160 readily apparent. In any embodiment, the protruding indicator 165 may be colored in any color and may be formed with any feature (e.g. a protrusion or indentation in any suitable shape or form) which would make the position of the indicator 165 apparent to a user. In some examples, near the position indicator slot 113 may be disposed predetermined, for example, engraved, indicator positions, for example, hash mark indicator positions, to make setting a blade position (e.g. depth) more visible and apparent to a user. For example, an exterior surface of the rear body shell 116 may include hash mark indicator positions to indicate the relative position of the protruding indicator 165, which may be configured to correspond to the extent to which the blade 102 will extend upon a user's forward engagement of the switch member 112. In some embodiments, as in the depicted example, near the position indicator slot 113 may be a "+" indicator component 108 and a "−" indicator component 109 which may assist users in determining the direction of movement of the position setting component 152 (as shown in FIGS. 10 and 11). In some examples, the indicator components 156 and 157 near the dial component 151 and the indicator components 108 and 109 correspond to each other such that, for example, rotation of the dial component 151 clockwise or counter-clockwise towards the "+" indicator component 156 may direct the movement of the protruding indicator 165 towards the "+" indicator component 108 near the position indicator slot 113. Conversely, rotation of the dial component 151 clockwise or counter-clockwise towards the "−" indicator component 157 may direct the movement of the protruding indicator 165 towards the "−" indicator component 109 near the position indicator slot 113. In some examples, the relative position of the protruding indicator may correspond to the position a blade 102 would achieve upon engagement of the cutting assembly 115, for example, using the switch member 112.

Figure 7:
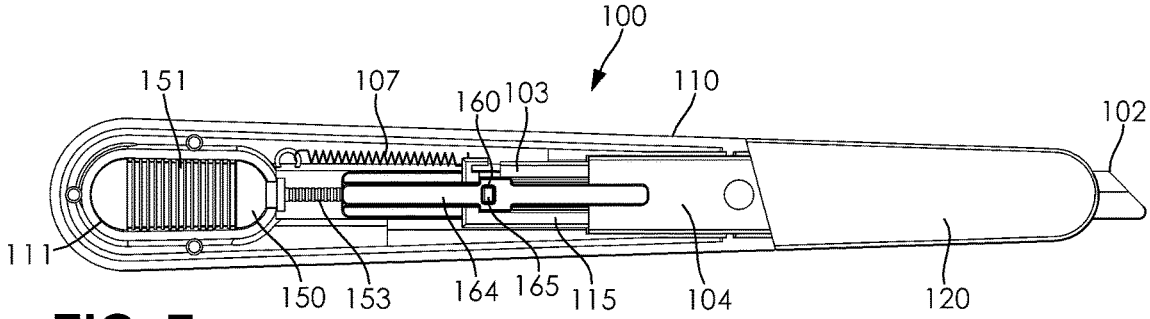
FIG. 7 is a rear view of an exemplary automatically retractable cutting device with the rear body shell removed to demonstrate the relative positions of the interior components of the cutting device when the blade is in a partially extended position, in accordance with an embodiment of the present invention.

FIG. 7 is a rear view of an exemplary automatically retractable cutting device with the rear body shell removed to demonstrate the relative positions of the interior components of the cutting device when the blade is in an exemplary partially extended position, in accordance with an embodiment of the present invention. As demonstrated in FIG. 7, the position indicator component 160 may be disposed on or along the post component 153 of the blade adjustment assembly 150. In some examples, the position indicator component 160 may be configured to move along the post component 153 of the blade adjustment assembly 150. In some examples, movement of the position setting component 152 (as shown in FIGS. 10 and 11) directs the movement of the position indicator component 160 (e.g. by directing the movement of the flanges 161 (as shown in FIGS. 10 and 11) disposed on the elongate member 164, opposite the indicator 163 disposed on the position indicator component 160). In some examples, rotation of the dial component 151 may direct the movement of the position setting component 152 (as shown in FIGS. 10 and 11) and/or the indicator component 160. In the depicted example, at least a portion of the cutting assembly 115 is moved forward in housing 110 to partially expose the blade 102. For example, the slider switch 112 is moved forward up to a location permissible by (e.g. the boundary formed by) the position setting component 152 (shown in FIGS. 10 and 11) and/or the flanges 161 (shown in FIGS. 10 and 11) of the position indicator component 160 to partially expose the blade 102. As shown in the depicted example, the position setting component 152 and/or the position indicator component 160 may be configured as a moveable boundary for at least a portion of the cutting assembly 115, and may thereby control the possible distance the blade 102 may travel out of the blade outlet slot 122 of the cover 120.

Figure 8:
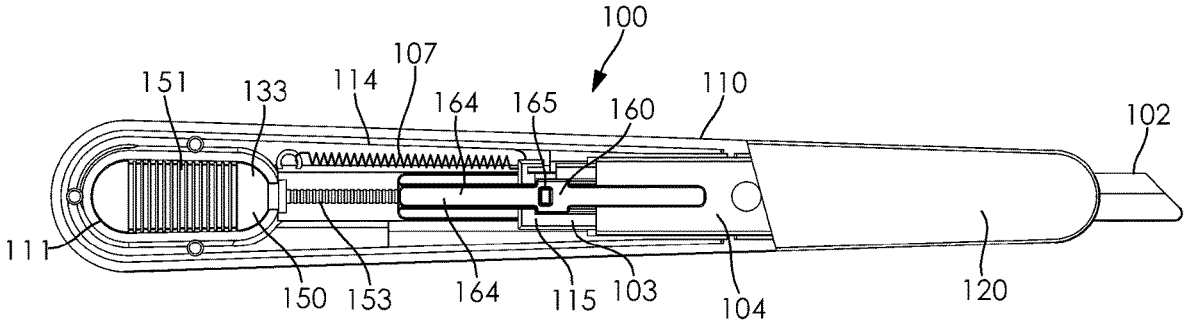
FIG. 8 is a rear view of an exemplary automatically retractable cutting device with the rear body shell removed to demonstrate the relative positions of the interior components of the cutting device when the blade is in a substantially extended position, in accordance with an embodiment of the present invention.

FIG. 8 is a rear view of an exemplary automatically retractable cutting device with the rear body shell removed to demonstrate the relative positions of the interior components of the cutting device when the blade is in an exemplary fully extended position, in accordance with an embodiment of the present invention. As demonstrated in FIG. 8, at least a portion of the cutting assembly 115 is moved forward in housing 110 to substantially expose the blade 102. For example, the slider switch 112 is moved forward up to a location permissible by (e.g. the boundary formed by) the position setting component 152 (shown in FIGS. 10 and 11) and/or the flanges 161 (shown in FIGS. 10 and 11) disposed on the elongate member 164 of the position indicator component 160 to substantially expose the blade 102. As shown in the depicted example, the position setting component 152 and/or the position indicator component 160 may be configured as a moveable boundary for at least a portion of the cutting assembly 115, and may thereby control the possible distance the blade 102 may travel out of the blade outlet slot 122 of the cover 120. As further demonstrated by the depicted example, the blade carriage 103 may be configured to travel along the blade carriage track 104, up until the movement boundary determined by the position of the position setting component 152 and/or the flanges 161 of the position indicator component 160.

Figure 9:
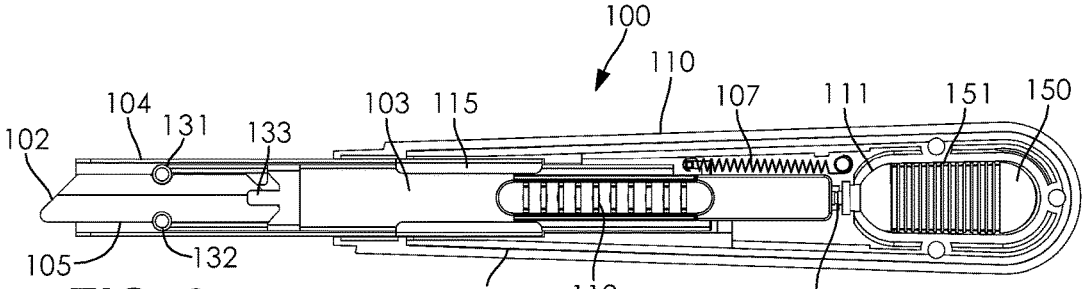
FIG. 9 is a front view of an exemplary automatically retractable cutting device with the front body shell and blade cover removed to demonstrate the relative positions of the interior components of the cutting device when the blade is in a partially extended position, in accordance with an embodiment of the present invention.

FIG. 9 is a front view of an exemplary automatically retractable cutting device with the front body shell and blade cover removed to demonstrate the relative positions of the interior components of the cutting device when the blade is in a partially extended position, in accordance with an embodiment of the present invention. As shown in FIG. 9, the slider switch 112 may be moved forward in the housing 110 to expose the blade 102. As shown in the depicted example, the tension component 107 may be biased to direct the blade 102 to a retracted blade position. In some examples, a force greater than the biasing force of the tension component 107 may be applied to the slider switch 112 to expose the blade 102 from within the housing 110. In some examples, the movement boundary of the slider switch 112 may be defined by the placement of the position setting component 152. For example, if the position setting component 152 is moved to a position corresponding to a middle position along the slider switch slot 117, the slider switch 112 may only move as far as permitted by the position setting component 152.

As further shown in FIG. 9, a blade 102 may be placed in the blade channel 105, with the blade notch 118 received in the first locking member 131, the cutting edge of the blade received in the second locking member 132, and the rear end of the blade received by the third locking member 133.

As shown in the figures, in some examples, the blade carriage 103 may move within the housing 110 between a retracted position as illustrated in FIG. 1, a partially extended position as demonstrated in FIG. 7, and a substantially or fully extended position as illustrated in FIG. 8. In any example, the blade carriage 103 may be moved to a fully retracted position, a fully extended position, or any position between the fully retracted position and the fully extended position.

FIG. 10 depicts a front exploded perspective view of an exemplary automatically retractable cutting device in accordance with an embodiment of the present invention. As shown in FIG. 10, a cutting device 100 may comprise a housing 110, a cutting assembly 115, and a cover member 120. The cutting assembly 115 may comprise a blade carriage 103, a switch member 112, a blade carriage track 104, and a blade 102. The blade 102 may be removably disposed in the blade carriage 103. The blade carriage 103 may be movably disposed within the housing 110, for example, along the blade carriage track 104. The blade carriage track may comprise one or more elongated tabs 137, at least partially engageable with a portion of the blade carriage 103 and configured to stabilize the position and/or the movement of the blade carriage 103 along the blade carriage track 104. In some examples, the blade carriage 103 may include a blade channel 105 formed as a cavity. The blade channel 105 may be configured with a spine or top side and a "belly" or bottom side and may be configured (e.g., shaped and/or sized) to receive at least a portion of the blade 102. In some examples, the spine or top side of the blade channel may be configured to receive either a top or bottom edge of a blade 102. Similarly, the "belly" or bottom side of the blade channel 105 may be configured to receive either a top or bottom edge of the blade.

As further shown in FIG. 10, the blade channel 105 may include one or more locking members, for example, a first locking member 131 a second locking member 132, and a third locking member 133. A portion of the locking members 131, 132 and 133 may be configured to be received by a portion of the blade 102 when the blade 102 is received in the blade channel 105. For example, the locking members 131 and 132 may include tab implements 144 configured to fit in a corresponding notch 118 in the blade 102. The blade channel 105 may securely retain blade 102 in such a manner so as to substantially prevent blade 102 from becoming dislodged or otherwise falling out of the blade carriage 103. The securing of blade 102 in the blade channel 105 of the blade carriage 103 may be a friction-fit attachment between blade 102 and wall portions of the blade channel 105, the first locking member 131, the second locking member 132 and/or the third locking member 133 of the blade channel 105. Each of the locking members 131, 132 and 133 may be configured with one or more indented portions 143 configured to receive or secure at least one edge of the blade 102. For example, the indented portion 143 of the second locking member 132 may be configured to receive a cutting or "belly" edge of the blade 102 and the indented portion 143 of the third locking member 133 may be configured to receive a rear edge of the blade 102. The locking members 131, 132 and 133 may be configured to assist in releasably securing the blade 102 to the blade channel 105 in one of many available positions. For example, the notch 118 of the blade 102 may engage with locking member 131 or locking member 132 such that either the front or rear tip of the blade 102 may be disposed nearest the blade outlet slot 122 in the cover member 120. Also for example, each indented portion 143 of the locking members 131 and 132 may be configured to receive the cutting edge or "belly" side of the blade 102 such that the blade 102 may be retained within the blade channel 105 with the spine of the blade 102 corresponding or aligned with the spine of the blade channel 105. Alternatively, the orientation of the blade 102 may be flipped, such that the spine of the blade 102 corresponds or aligns with the "belly" or bottom side of the blade channel 105. Such a configuration of the blade channel 105 may assist a user in easily reorienting the blade 102 in the blade channel 105, for example, without the use of additional tools, to adjust the cutting device 100 such that it is compatible for both left-handed and right-handed users (e.g. ambidextrous). In some examples, the third locking member 133 may secure a rear end of the blade 102 to the blade channel 105. In some scenarios, the locking members 131, 132, and 133 may be configured to hold the blade 102 in place and prevent the blade 102 from dislodging when the cover member 120 is removed during various operations such as blade replacement or reorientation.

As further demonstrated in FIG. 10, the blade carriage 103 may include a switch member 112. The switch member 112 may be a member that extends or protrudes from the blade carriage 103. The switch member 112 may include a plurality of textured areas, for example, ridges, disposed on a surface of switch member 112. The switch member 112 may be received in aperture 117 of housing 110. The switch member 112 may be configured to move within the aperture 117 of the housing 110, as permitted by the position setting component 152. For example, the placement of the position setting component 152 may define a range of movement through which switch member 112 may be moved (e.g., may define the range of movement through which the blade carriage 103 may be moved within housing 110). In some examples, the aperture 117 may provide a maximum movement boundary for the switch 112, for example, a maximum forward movement boundary of the switch member 112. The switch member 112 may be formed with or extend toward the blade carriage 103. Alternatively, the switch member 112 may be a member that is attached to a portion of the blade carriage 103. A user of the cutting device 100 may interact with the switch member 112 to move the blade carriage 103 within the housing 110. The ridges may assist a user with maintaining positive contact (e.g., non-slipping contact) with the switch member 112 as the user pushes or pulls at the switch member 112.

FIG. 11 depicts a rear perspective exploded view of an exemplary automatically retractable cutting device in accordance with an embodiment of the present invention. As shown in FIG. 11, the cover member 120 may be configured to be removably attachable to housing 110. For example, the cover member 120 may be a cap that is attachable to housing 110. The cover member 120 may include a cavity formed by one or more interior wall portions of the cover member 120. Portions of the blade carriage 103, blade 102, and/or housing 110 may be received in the cavity formed in the cover member 120 (e.g., when cover member 120 is attached to housing 110). The cover member 120 may include a blade outlet slot 122 that may be configured to receive a portion of the blade 102 (e.g., when cover member 120 is attached to housing 110). The cover member 120 may also include one or more notches (not shown) (e.g., protruding portion notches) that are configured to receive one or more blade cover connector components or protruding portions 119 (e.g., when cover member 120 is attached to housing 110). As illustrated in FIGS. 10 and 11, the cover member 120 may have an end portion 123 that may be diagonal or slanted or relative to a lengthwise direction of the cover member 120. The end portion 123 may help in forming an attachment between the cover member 120 and a diagonal or slanted portion of housing 110 (e.g., when the protruding portions 119 are received in the cover member notches 129).

As further shown in FIG. 11, the cutting assembly 115 may comprise a tension component 107. The tension component 107, for example, a spring, may be disposed between the blade carriage 103 and an internal wall of the housing 110. The tension component 107 may be configured to bias the blade carriage 103 towards the retracted blade position such that the blade 102 disposed in the blade channel 105 may be biased towards the interior of the housing 110. In some scenarios, if a force, for example, a forward force, greater than the biasing force applied by the tension component 107 is applied to the switch member 112 of the blade carriage 103, the blade carriage 103 may move forward such that the blade 102 disposed in the blade channel 105 may extend past the blade outlet slot 122 in the blade cover member. Moreover, if a force is released or not applied to the switch member 112 or the blade carriage 103 (or the force applied to the blade carriage 103 is lower than the biasing force applied by the tension component 107), the tension component 107 may direct the blade carriage 103 to automatically retract to return the blade 102 to its retracted position. This configuration of the cutting device 100 may provide a safety feature to the device, such that the blade 102 does not remain extended or exposed and likely to cause injury, for example, when the blade 102 is not in use by a user.

As shown in FIGS. 10 and 11, the blade carriage track 104 may be disposed between the rear body shell 116 and the blade carriage 103. The blade carriage track may include a blade carriage channel 106. The blade carriage channel 106 may be a void or path formed in the blade carriage track 104 that creates a passage for the blade carriage 103 to move from a first position to a second position. The blade carriage track 104 may be configured as a sheath and may stabilize the blade carriage 103. In some examples, as in the depicted example, the blade carriage track 104 may include one or more elongated tabs 137, at least partially engageable with a portion of the blade carriage 103 and configured to stabilize the position and/or the movement of the blade carriage 103 along the blade carriage track 104.

FIG. 12 depicts a front perspective exploded view of an exemplary manually retractable cutting device in accordance with an embodiment of the present invention. As shown in FIG. 12, a cutting device 100 may comprise a housing 110, a cutting assembly 115, and a cover member 120. The cutting assembly 115 may comprise a blade carriage 103, a switch member 112, a blade carriage track 104, and a blade 102. The blade 102 may be removably disposed in the blade carriage 103. The blade carriage 103 may be movably disposed within the housing 110, for example, along a blade carriage track 104. As demonstrated in FIG. 12, a position indicator component 160 may be disposed on or along the post component 153 of the blade adjustment assembly 150. In some examples, the position indicator component 160 may be configured to move along the post component 153 of the blade adjustment assembly 150 and may be configured to indicate the extent of extension of the blade 102, through the position indicator slot 113. In some examples, movement of the position setting component 152 directs the movement of the position indicator component 160 (e.g. by directing the movement of the flanges 161 disposed on the elongate member 164, opposite the indicator 163 disposed on the position indicator component 160). In some examples, rotation of the dial component 151 may direct the movement of the position setting component 152 and/or the indicator component 160. In some examples, at least a portion of the cutting assembly 115 may be moved forward in housing 110 to partially expose the blade 102. For example, the slider switch 112 may be moved forward along the post component 153 to a location determined by the position or location of the position setting component 152 and/or the flanges 161 of the position indicator component 160 to partially expose the blade 102. As shown in the depicted example, the position setting component 152 and/or the position indicator component 160 may be configured to control or direct the movement of a portion of the cutting assembly 115, and may thereby control the distance the blade 102 may travel out of the blade outlet slot 122 of the cover 120.

As further shown in FIG. 12, the blade channel 105 may include one or more locking members, for example, a first locking member 131 a second locking member 132, and a third locking member 133. A portion of the locking members 131, 132 and 133 may be configured to be received by a portion of the blade 102 when the blade 102 is received in the blade channel 105. For example, the locking members 131 and 132 may include tab implements 144 configured to fit in a corresponding notch 118 in the blade 102. The blade channel 105 may securely retain blade 102 in such a manner so as to substantially prevent blade 102 from becoming dislodged or otherwise falling out of the blade carriage 103. The securing of blade 102 in the blade channel 105 of the blade carriage 103 may be a friction-fit attachment between blade 102 and wall portions of the blade channel 105, the first locking member 131, the second locking member 132 and/or the third locking member 133 of the blade channel 105. Each of the locking members 131, 132 and 133 may be configured with one or more indented portions 143 configured to receive or secure at least one edge of the blade 102. For example, the indented portion 143 of the second locking member 132 may be configured to receive a cutting or "belly" edge of the blade 102 and the indented portion 143 of the third locking member 133 may be configured to receive a rear edge of the blade 102. The locking members 131, 132 and 133 may be configured to assist in releasably securing the blade 102 to the blade channel 105 in one of many available positions. For example, the notch 118 of the blade 102 may engage with locking member 131 or locking member 132 such that either the front or rear tip of the blade 102 may be disposed nearest the blade outlet slot 122 in the cover member 120. Also for example, each indented portion 143 of the locking members 131 and 132 may be configured to receive the cutting edge or "belly" side of the blade 102 such that the blade 102 may be retained within the blade channel 105 with the spine of the blade 102 corresponding or aligned with the spine of the blade channel 105. Alternatively, the orientation of the blade 102 may be flipped, such that the spine of the blade 102 corresponds or aligns with the "belly" or bottom side of the blade channel 105. Such a configuration of the blade channel 105 may assist a user in easily reorienting the blade 102 in the blade channel 105, for example, without the use of additional tools, to adjust the cutting device 100 such that it is compatible for both left-handed and right-handed users (e.g. ambidextrous). In some examples, the third locking member 133 may secure a rear end of the blade 102 to the blade channel 105. In some scenarios, the locking members 131, 132, and 133 may be configured to hold the blade 102 in place and prevent the blade 102 from dislodging when the cover member 120 is removed during various operations such as blade replacement or reorientation.

FIG. 13 depicts a rear perspective exploded view of an exemplary manually retractable cutting device in accordance with an embodiment of the present invention. As shown in the demonstrated example, an interior portion of the front body shell 114 may comprise one or more rib or groove members 167 configured to stabilize at least a portion of the cutting assembly 115, for example, the blade carriage 103. In some scenarios, blade carriage 103 may comprise a hardstop 168 and a pocket 169. In some examples, the hardstop 168 may be a boundary for the movement of the position setting component 152 (e.g., the position setting component 152 may not be able to move rearward with respect to the housing 110 past the position of the hardstop 168) thereby setting the boundary for the cutting assembly 115. In some examples, a portion of the blade adjustment assembly 150 (e.g., the one or more flanges 161 of the blade adjustment assembly 150) may be configured to engage with (e.g, abut at least a portion of) the hardstop 168 of the blade carriage 103 to direct the movement of the blade carriage 103 and the blade 102 disposed thereon.

As further demonstrated by FIG. 13, in some examples, the position indicator component 160 may be configured to move along the post component 153 of the blade adjustment assembly 150. In some examples, movement of the position setting component 152 may direct the movement of the position indicator component 160 (e.g. by directing the movement of the flanges 161 disposed on the elongate member 164, opposite the indicator 163 disposed on the position indicator component 160). In some examples, clockwise or counter-clockwise rotation of the dial component 151 may direct the movement of the position setting component 152 and/or the indicator component 160. In some scenarios, the position setting component 152 and/or the position indicator component 160 may be configured to direct the movement of at least a portion of the cutting assembly 115 thereby directing the movement the blade 102 may travel out of the blade outlet slot 122 of the cover 120.

The exemplary cutting device 100 may be constructed from any suitable variety of durable materials. For example, some or most of the components of the exemplary cutting device 100 may be formed from plastic or a plastic composite material. Also for example, some or most of the components of the exemplary cutting device 100 may be formed from metal or metal alloy. Further for example, the exemplary cutting device 100 may include ceramic material. For example, cutting device 100 may be formed from plastic, plastic composite, metal, metal alloy, and/or ceramic materials. For example, housing 110 and/or cover member 120 may be formed partially or substantially entirely from plastic, plastic composite, metal, and/or metal alloy materials. For example, housing 110 and/or cover member 120 may be plastic or metal structural members. As described further below, cutting assembly 115 may include components formed from plastic, plastic composite, metal, and/or metal alloy materials and components formed from ceramic materials. Also for example, certain components of cutting device 100 may include specific materials based upon the application or function of a given component. For example, members of cutting device 100 designed to come into contact with a cutting surface and that may be subject to constant friction may include materials resistant to friction such as glass-filled nylon and/or polyamide plastic. For example, cutting device 100 may include any suitable materials for use in a cutting device such as, e.g., a box cutter, a utility knife, a seam ripper, or a precision knife.

The blade 102 may be any suitable blade or cutter for cutting of a material by cutting device 100. For example, the blade 102 may be formed from a ceramic material that is capable of withstanding extended use before becoming dull or unusable. For example, the blade 102 may be a ceramic blade. Also for example, the blade 102 may include ceramic materials such as Zirconium Oxide or any other suitable ceramic materials for use in a blade. For example, the blade 102 may be a ceramic blade that may be a hooked blade formed from Zirconium Oxide. Alternatively for example, the blade 102 may be a metal blade or a blade formed from any suitable material than can be used for cutting materials. The blade 102 may include rounded tips to reduce the chance of a user being cut unintentionally by the blade 102.

The exemplary disclosed device and method may provide an intuitively simple and safe technique for cutting materials and/or replacing blades of a cutting device. The exemplary disclosed device and method may be used in any application involving cutting materials safely. For example, the exemplary cutting device and method may be used in applications such as pen cutters, seam rippers, box cutters, utility knives, precision knives, and any other suitable application for cutting materials.

An exemplary operation of cutting device 100 will now be described. As illustrated in FIGS. 1-13, the housing 110 is provided including cover member 120. The cutting assembly 115 is disposed in housing 110. The blade 102 is removably disposed in the blade channel 105 of the blade carriage 103.

As illustrated in FIGS. 1-2, the cutting assembly 115 including the blade 102 disposed in the blade carriage 103 may be in a retracted position. The switch member 112 may be disposed at a rear portion of the aperture 117 as illustrated in FIGS. 1 and 4 when the cutting assembly 115 is in the retracted position. As illustrated by FIG. 7, the cutting assembly including the blade 102 disposed in the blade carriage may be in a partially extended position. In such a scenario, the switch member 112 may be disposed in a middle portion of the aperture 117 when the cutting assembly 115 is in a partially extended position. As illustrated by FIG. 8, the cutting assembly including the blade 102 disposed in the blade carriage may be in a substantially or fully extended position. The switch member 112 may be disposed in a front portion of the aperture 117 as illustrated in FIG. 3 when the cutting assembly 115 is in a substantially or fully extended position.

In accordance with an exemplary usage scenario, the cutting depth or position of the cutting assembly 115 may pre-selected by a user, such that the cutting assembly may be partially extended (as shown in FIG. 7) or substantially extended (as shown in FIGS. 3 and 5) upon the forward engagement of the switch member 112. A user may pre-select the depth (e.g. potential extension) of the cutting assembly by rotating the dial adjustment component 151 to move the position setting component 152, for example, a rotatable member or nut, along the post component 153, for example, a threaded post, such that one or more flanges 161, for example, a pair of flanges 161, of the position setting component 152 move in accordance with the movement of the position setting component 152 disposed between the pair of flanges 161. In some examples, the movement of the position setting component 152 directs the movement of the position indicator component 160 (e.g. by directing the movement of the flanges 161 disposed on the elongate member 164, opposite the indicator 163 disposed on the position indicator component 160). In some scenarios, a user may then move the cutting assembly 115 to the preselected blade length or depth by pushing the switch member 112 of the blade carriage 103 forward in the aperture 117 to the extent permissible by the position setting component 152, for example, until a portion 101 of the blade carriage 103 abuts a portion of the position setting component 152 and/or a portion of the position setting component 160. In some examples, either the position setting component 152 or one of the flanges 161 in operable engagement therewith may prevent the lateral movement of the switch member 112 past a certain extent (e.g. the position setting component 152 may set the maximum movement boundary of the switch member 112, for example, a maximum forward movement boundary of the switch member 112, thereby pre-setting the maximum movement boundary (e.g. maximum pre-selected depth) of the blade 102 operably connected thereto).

A user of cutting device 100 may attach the cover member 120 to the housing 110 when the cutting assembly 115 is in the retracted or extended positions. The cover member 120 may be pushed by a user onto the housing 110 until the blade cover connector components or protruding portions 119 of the housing 110 are received by the one or more notches 129 of the cover member 120.

It is also contemplated that the cutting assembly may automatically retract to the position illustrated in FIGS. 1-2. For example, the tension component 107, for example, a spring, may be configured to bias the blade carriage 103 to retract such that the blade 102 disposed in the blade channel 105 of the blade carriage 103 may be biased towards the interior of the housing 110. In some scenarios, if a force greater than the biasing force applied by the tension component 107 is applied to the switch member 112 connected to the blade carriage 103, the blade carriage 103 may move forward such that the blade 102 disposed in the blade channel 105 may extend past the blade outlet slot 122 in the blade cover member 120. Moreover, if a force is released or not applied the switch member 112 or the blade carriage 103 (or the force applied to the blade carriage 103 is lower than the biasing force applied by the tension component 107), the tension component 107 may be configured to direct the blade carriage 103 to automatically retract to return the blade 102 to the retracted position shown in FIGS. 1-2.

If desired, a user of the cutting device 100 may remove blade 102. For example, the blade 102 may be removed from the blade carriage 103 when the cover member 120 is removed to expose the blade carriage 103. For example, a user may replace a used blade 102 with a new blade 102 when the cover member 120 is removed from the housing 110. For example, a user of cutting device 100 may replace a relatively dull blade 102 that has been used many times for cutting material with a new blade 102. Also for example, a user may reorient the blade 102 in the blade channel 105 such that the spine of the blade 102 either aligns with or opposes the spine side of the blade channel 105 and may thus adjust the cutting device 100 such that it is compatible for both left-handed and right-handed uses (e.g. ambidextrous).

As shown in FIGS. 12-13, the cutting device 100 may be configured to manually extend and retract. For example, the blade adjustment assembly 150 may be utilized to manually extend and retract the blade 102. In an illustrative example, the dial component 151 of the blade adjustment assembly 150 may be rotated clockwise or counter-clockwise to move the blade 102 forward or rearward with respect to the housing to manually extend or retract the blade 102 out of the blade outlet slot of the cover 120. In some examples, movement of the position setting component 152 and/or the flanges 161 of the blade adjustment assembly 150 directs the movement of the blade carriage 103 having a portion thereof (e.g., a hardstop 168) engaged with the position setting component 152 and/or the one or more flanges 161 to move the blade 102 operably connected to the blade carriage 103 to extend or retract the blade 102, as desired by a user.

The exemplary disclosed cutting device and method may provide an intuitively simple device and technique for safely and easily replacing blades of the cutting device. The exemplary device may allow users unfamiliar with the device to quickly, easily, and safely replace the blades. The exemplary device and method may also provide a user with a cutting device having a blade that may be resistant to dulling and may be used for relatively long periods of time without replacing a blade. The exemplary device and method may provide an ergonomically efficient device and method that allows a user to avoid frustration in using a cutting device, including during replacement of the device blades.

It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments.

It will be apparent to those skilled in the art that various modifications and variations can be made to the disclosed cutting device and method. Other embodiments will be apparent to those skilled in the art from consideration of the specification and practice of the disclosed method and apparatus. It is intended that the specification and examples be considered as exemplary only, with a true scope being indicated by the following claims.

What is claimed is:

1. A cutting device, comprising:

a housing;

a blade carriage that is movably disposed in the housing, the blade carriage having a blade channel configured to releasably receive a blade, and the blade carriage being movable between a retracted position and an extended position;

a position adjustment assembly in mechanical communication with the carriage, the position adjustment assembly comprising at least a dial component having a post component extending therefrom, with a position setting component disposed between a pair of flanges extending from a position indicator component and adapted to travel along the post component to direct movement of the blade carriage to one or more blade carriage positions corresponding to one or more position setting component positions;

a cover member that is removably attached to a portion of the housing and formed with a blade outlet slot; and wherein the blade channel comprises one or more locking tabs adapted to releasably secure the blade in a first position wherein a top side of the blade aligns with a top side of the blade channel and a second position wherein a top side of the blade aligns with a bottom side of the blade channel.

2. The cutting device of claim 1, wherein removal of the cover member exposes at least a portion of the carriage and the blade disposed therein.

3. The cutting device of claim 1, wherein the blade channel comprises one or more locking members.

4. The cutting device of claim 3, wherein each locking member comprises one or more tab implements and one or more indented portions.

5. The cutting device of claim 4, wherein at least one of the tab implements is adapted to be releasably received in at least one blade notch, and at least one of the indented portions is adapted to selectively receive a portion of the cutting edge of the blade.

6. The cutting device of claim 5, wherein at least one of the tab implements is adapted to receive a rear edge of the blade.

7. A cutting device, comprising:

a housing that is a handle;

a blade carriage that is movably disposed in the housing, the blade carriage operably engaged with a switch member and having a blade channel, the blade carriage being movable between a retracted position and an extended position;

a blade having one or more notches, the blade being removably disposed in the blade channel;

a position adjustment assembly in mechanical communication with the carriage, the position adjustment assembly comprising at least a dial component extending towards a threaded post having a position setting component disposed between a pair of flanges extending from a position indicator component, the position setting component adapted to laterally travel along the threaded post upon rotation of the dial component to move the position setting component and restrict movement of the blade carriage past a selected position of the position setting component; and a blade cover having a blade outlet slot, the blade cover being removably attachable to a portion of the housing;

wherein the blade channel comprises one or more locking members comprising one or more tab implements and one or more indented portions, at least one of the tab implements adapted to be releasably received in at least one blade notch, and at least one of the indented portions adapted to selectively receive a portion of the cutting edge of the blade.

8. The cutting device of claim 7, wherein the housing is formed with a position indicator slot.

9. The cutting device of claim 7, wherein the blade carriage is operably connected to a tension component configured to bias the blade carriage towards the retracted position.

10. The cutting device of claim 7, wherein the locking members are configured to releasably secure the blade in a first position wherein a top side of the blade aligns with a top side of the blade channel and a second position wherein the top side of the blade aligns with a bottom side of the blade channel.

11. The cutting device of claim 7, the position indicator component is configured to indicate a depth the blade will travel upon engagement of the switch member.

12. The cutting device of claim 11, wherein a movement of the position indicator component corresponds to a movement of the position setting component.

13. A cutting device, comprising:

a housing that is a handle sized and dimensioned to fit in a user hand;

a blade having a top side formed with one or more notches opposing a bottom side formed as a cutting edge;

a moveable blade carriage disposed in the housing and formed with a blade channel configured to receive a blade, the blade channel having a top edge formed with a first locking member opposing a bottom edge formed with a second locking member, and a rear edge formed with a third locking member, each locking member comprising one or more tab implements and one or more indented portions, at least one of the tab implements adapted to be releasably received in at least one blade notch, and at least one of the indented portions adapted to selectively receive a portion of the cutting edge of the blade;

a switch member in mechanical communication with the blade carriage;

a blade cover removably attached to the housing adapted to provide access to blade carriage;

a blade adjustment assembly comprising a dial component extending towards a threaded post having a rotatable member disposed thereon adapted to laterally travel along the threaded post upon rotation of the dial component to move the rotatable member and restrict movement of the blade carriage past a point defined by the position of the rotatable member;

a position indicator component comprising a pair flanges between which the rotatable member is disposed, the position indicator component configured to indicate a position of the rotatable member.

14. The cutting device of claim 13, wherein the rotatable member defines a forward movement boundary of the blade carriage.

15. The cutting device of claim 13, wherein the threaded post is disposed alongside the blade carriage.

16. The cutting device of claim 13, wherein the locking members are configured to releasably secure the blade in a first position wherein the top side of the blade aligns with the top side of the blade channel and a second position wherein the top side of the blade aligns with the bottom side of the blade channel.

17. The cutting device of claim 13, wherein movement of the rotatable member directs movement of the position indicator component.

18. The cutting device of claim 17, wherein at least one of the flanges of the position indicator component is configured to abut a portion of the blade carriage upon a forward movement of the switch member to prevent movement of the blade carriage past a position of at least one of the flanges of the position indicator component.

* * * * *